US008047037B2

(12) United States Patent
Vehof et al.

(10) Patent No.: US 8,047,037 B2
(45) Date of Patent: Nov. 1, 2011

(54) SHAPING TOOL

(75) Inventors: Robert Vehof, Amersfoort (NL); Peter Weber, Weingarten (DE); Armin Meier, Benningen (DE); Dieter Hartmann, Mutlangen (DE); Falk Leitner, Wäschenbeuren (DE); Mathieu Brand, Wijhe (NL); Reiner Kelsch, Mutlangen (DE)

(73) Assignee: voestalpine Automotive GmbH, Linz (AT)

( * ) Notice: Subject to any disclaimer, the term of this patent is extended or adjusted under 35 U.S.C. 154(b) by 416 days.

(21) Appl. No.: 11/991,512

(22) PCT Filed: Sep. 8, 2006

(86) PCT No.: PCT/EP2006/008793

§ 371 (c)(1),
(2), (4) Date: Jun. 12, 2009

(87) PCT Pub. No.: WO2004/028641

PCT Pub. Date: Mar. 15, 2007

(65) Prior Publication Data

US 2009/0293571 A1 Dec. 3, 2009

(30) Foreign Application Priority Data

Sep. 8, 2005 (DE) ..... 10 2005 042 765

(51) Int. Cl.
*B21D 26/02* (2011.01)

(52) U.S. Cl. ..... 72/60; 72/57; 29/421.1

(58) Field of Classification Search ..... 72/56, 60, 72/63, 370.22; 29/421.1
See application file for complete search history.

(56) References Cited

U.S. PATENT DOCUMENTS

| | | | | |
|---|---|---|---|---|
| 3,978,910 | A | 9/1976 | Gladwin | |
| 6,182,486 | B1 * | 2/2001 | Chuang | 72/46 |
| 6,910,358 | B2 * | 6/2005 | Schroth | 72/57 |
| 7,021,099 | B2 * | 4/2006 | Bennett et al. | 72/57 |
| 7,269,986 | B2 * | 9/2007 | Pfaffmann et al. | 72/60 |
| 7,823,430 | B2 * | 11/2010 | Hammar et al. | 72/57 |

FOREIGN PATENT DOCUMENTS

| | | |
|---|---|---|
| GB | 780 386 A | 7/1957 |
| GB | 2 240 300 A | 7/1991 |
| JP | 2005 007442 A | 1/2005 |

* cited by examiner

*Primary Examiner* — David Jones
(74) *Attorney, Agent, or Firm* — Setter Roche LLP

(57) ABSTRACT

The invention relates to a shaping tool which is used to shape a workpiece, in particular, a sheet steel component, comprising at least two shaping tool halves. Contoured regions are provided in the region of the shaping tool halves in order to give the workpiece a corresponding contour, at least in sections. Each shaping tool half has a shaping surface shell which is oriented towards the workpiece and a support shaping half. The shaping surface shell is arranged on the support shaping half and comprises a shaping surface, which is oriented towards the workpiece, and a rear side which is oriented away from the workpiece. The support shaping half comprises a contoured area which essentially corresponds to the contour of the workpiece which is to be produced and the contoured area is surrounded by a flange area. Grooves are provided in the contoured area in the region of the rear side of the shaping surface shell. The support shaping half comprises receiving surfaces which receive the support shaping half in a positive fit and the receiving surfaces and the grooves form cooling channels. The support shaping half comprises supply channels and discharge channels such that a coolant can be guided through the channels.

1 Claim, 5 Drawing Sheets

SHAPING TOOL

FIELD OF THE INVENTION

The invention relates to a shaping tool for shaping and/or cooling a component, in particular made of sheet steel.

BACKGROUND OF THE INVENTION

It is known to use water to cool shaping tools, i.e. an upper shaping tool half and a lower shaping tool half, which, corresponding with each other, impart a shape to an inserted blank or an inserted plate blank through the movement of the shaping tool halves toward each other, for example by means of deep drawing, so that an inserted hot blank or inserted hot plate blank, in particular made of sheet steel, is shaped and cooled. In hardenable steel plates, the cooling produces a desired hardening.

Usually, shaping tool halves of this kind are composed of cast or forged materials and the shaping tool halves each have a respective shape-imparting surface.

In order to carry out a cooling, it is known to introduce holes into shaping tool halves of this kind in order to thus produce cooling conduits.

For example, a multitude of bores are produced for this purpose, which extend essentially parallel to the intrinsically contoured shape-imparting surface, passing through the respective shaping tool half from one side to the opposite side. In order to be able to act on these cooling conduits with a corresponding coolant, in a second step, from the rear side opposite from the contoured surface of the shaping tool half, in the region of one end of the previously drilled cooling conduit, a connecting conduit is drilled to the cooling conduit so that through a bore, the cooling conduit can be acted on with coolant from the rear side of the shaping tool half, which coolant is conveyed through the other bore to the rear side of the shaping tool half. The open ends or the open end of the cooling conduit is usually closed with corresponding stoppers or closures in order to prevent the coolant from escaping out the side of the shaping tool.

In known shaping tools of this kind, it is disadvantageous that these cooled shaping tool halves are expensive and complex to manufacture; the achievable cooling area is not very large and as a result, the cooling is not always sufficiently effective.

The object of the present invention is to create a shaping tool which can be simply and quickly manufactured and has a highly effective cooling capacity.

SUMMARY OF THE INVENTION

According to the present invention, the shaping tool halves are composed of multiple shell-like parts. To this end, each shaping tool half has a respective shaping surface shell. The shaping surface shell is the component situated the closest to the work piece and has a shaping surface for the shaping of the shaping tool, which shaping surface has a shaping surface that is contoured in accordance with the desired contour of the work piece or contoured in accordance with the shaping. In this connection, the shaping surface shell is three-dimensionally embodied in accordance with this contour. This means that a formation of the shaping surface that is concave with regard to the surface or plane of the shaping surface shell constitutes a correspondingly convex formation on the rear side. The shaping surface shell has a preferably homogeneous thickness, for example of 10 to 40 mm. On the side opposite from the shaping surface, the shaping surface shell has a rear side; the rear side has cooling grooves milled into it. The cooling grooves have a width of 8 to 20 mm, for example; the cooling conduits have a U-shaped or rectangular cross section, for example, and between the cooling conduits, there are partitions that extend parallel to one another. The partitions each have a width, for example, of 3 to 15 mm. Depending on the thickness of the material of the shaping surface shell, the cooling conduits have a depth of 3 to 10 mm, in particular 5 to 6 mm.

The shaping surface shells extend in plate-like fashion beyond the actual forming contour on both sides of it and in these flange regions are provided, at regular or irregular spacings, holes or corresponding recesses in order to be able to screw these shaping surface shells to the respective support forms. Preferably, these threaded holes are encompassed by dome-like or truncated cylinder-like extensions on the rear side that engage in corresponding recesses of a support form and center the forming surface in relation to the support form.

The support form is a block-like structure, which has a receiving surface corresponding to the rear side of the forming surface shell, which receives the forming surface shell in a form-locked fashion. The receiving surface, the support form, and the cooling grooves form closed conduits; the partitions rest snugly against the receiving surface and separate the conduits from one another. In the vicinity of the beginning and end of the respective grooves that form the conduits, the support form has a bore or recess that extends from a rear side surface straight through to the receiving surface and thus connects the cooling conduits with a rear side of the support form in a fluid-conducting fashion. In the region of the rear side of the support form, a water chamber is provided, which connects all of the cooling conduit inlets or cooling conduit outlets to one another and extends in a corresponding fashion, which is externally acted on with water and distributes this water into the inlet conduits and therefore into the cooling conduits. The rear side of the support form is screwed to a shaping plate, which supports the form. This design thus achieves a shaping tool half equipped with a shaping surface shell; the shaping surface shell includes a shaping surface and cooling conduit grooves on the rear side, which follow the course of the contour of the work piece to be cooled. These grooves are produced in a simple fashion by being milled and in an equally simple fashion, are acted on through the support form by means of coolant, in particular water.

In the present invention, it is advantageous that the cooling conduits follow the contour of the shaping surface and therefore also the contour of the work piece. By contrast with this, in the prior art, such a cooling is not possible since it is not possible to produce corresponding cooling conduits by means of drilling at all locations in a form. Particularly with complicated three-dimensional forms, the cooling conduits must be drilled at a distance from the contour. As a result, such cooling conduits according to the prior art are spaced different distances apart from the contour of the work piece. This results in thermal stresses in the form itself and also in the work piece, which does not cool down uniformly in all locations.

It is also advantageous that the shaping surfaces can be produced in shells in a simple fashion; on the rear side of the shaping surface shell, the grooves can be produced in a simple fashion by being milled into it. It is additionally advantageous that the rectangular shape of the grooves increases the cross section through which the flow travels by contrast with round bores, thus making it possible to effectively increase the cooling capacity.

It is also advantageous that with rectangular grooves, turbulence occurs in the region of the boundary layer between the flowing coolant and the wall so that a laminar boundary layer that forms breaks up relatively quickly, thus permitting an increase in the mass flow and also the flow speed. Furthermore, the formation of a laminar boundary layer hinders the heat transfer between the wall and the coolant. The milled grooves can simply be left raw or can be provided with a definite surface by means of shot peening or sandblasting so as to provoke the break-up of the laminar boundary layer.

According to the present invention, a tool steel, gray-cast iron, or precision-cast steel can be used as material for the shaping surface shells. Preferably, though, a material that has a higher thermal conduction capacity is selected for the shaping surface shells. These materials include, for example, bronze alloys, in particular those of the kind sold by the Ampco Metal company under the name Ampcoloy® 940 or Ampcoloy® 972. These are materials that are essentially composed of copper; in addition to copper, they also contain chromium, nickel, silicon, and possibly other accompanying metal impurities. For example, the chromium contents of such special materials range between 0.4 and 1.0%, the nickel content ranges between 0 and 2.5%, and the silicon content ranges between 0 and 0.7%; for example, the alloy can also contain a zirconium content of 0.12%. It is also conceivable, however, to use other copper alloys such as bronze in particular, or to use pure copper.

The invention will be explained in conjunction with the drawings.

DETAILED DESCRIPTION OF THE PREFERRED EMBODIMENTS

Figure 1:
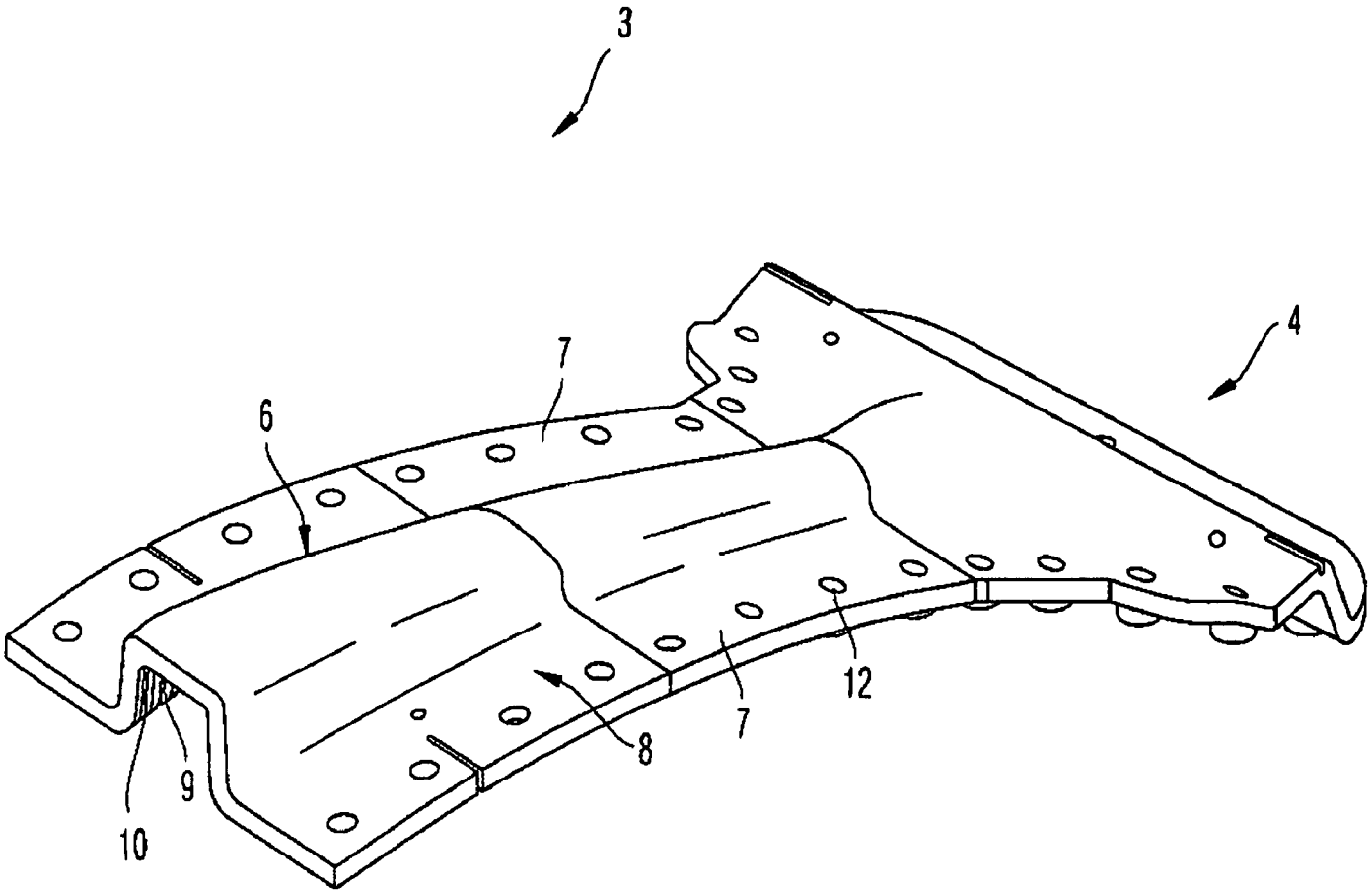
FIG. 1 shows the shaping surface shell of a shaping tool according to the invention and a shaping tool half according to the invention, in a top view of the shaping surface.

The shaping tool 1 according to the invention (FIG. 5) has an upper shaping tool half 2 and a lower shaping tool half 3. Each shaping tool half has a shaping surface shell 4 oriented toward the work piece and a form supporting half 5 that supports the shaping surface shell 4.

A shaping surface shell 4 is a plate-like component with a thickness of for example 10 to 50 mm; each shaping surface shell 4 has a contoured region 6, in which the shaping surface shell 4 essentially corresponds to the contour of a work piece to be shaped, and a flange region 7, which is situated adjacent to the contoured region 6 and is used to attach the shaping surface shell 4 to a form supporting half 5.

Figure 2:
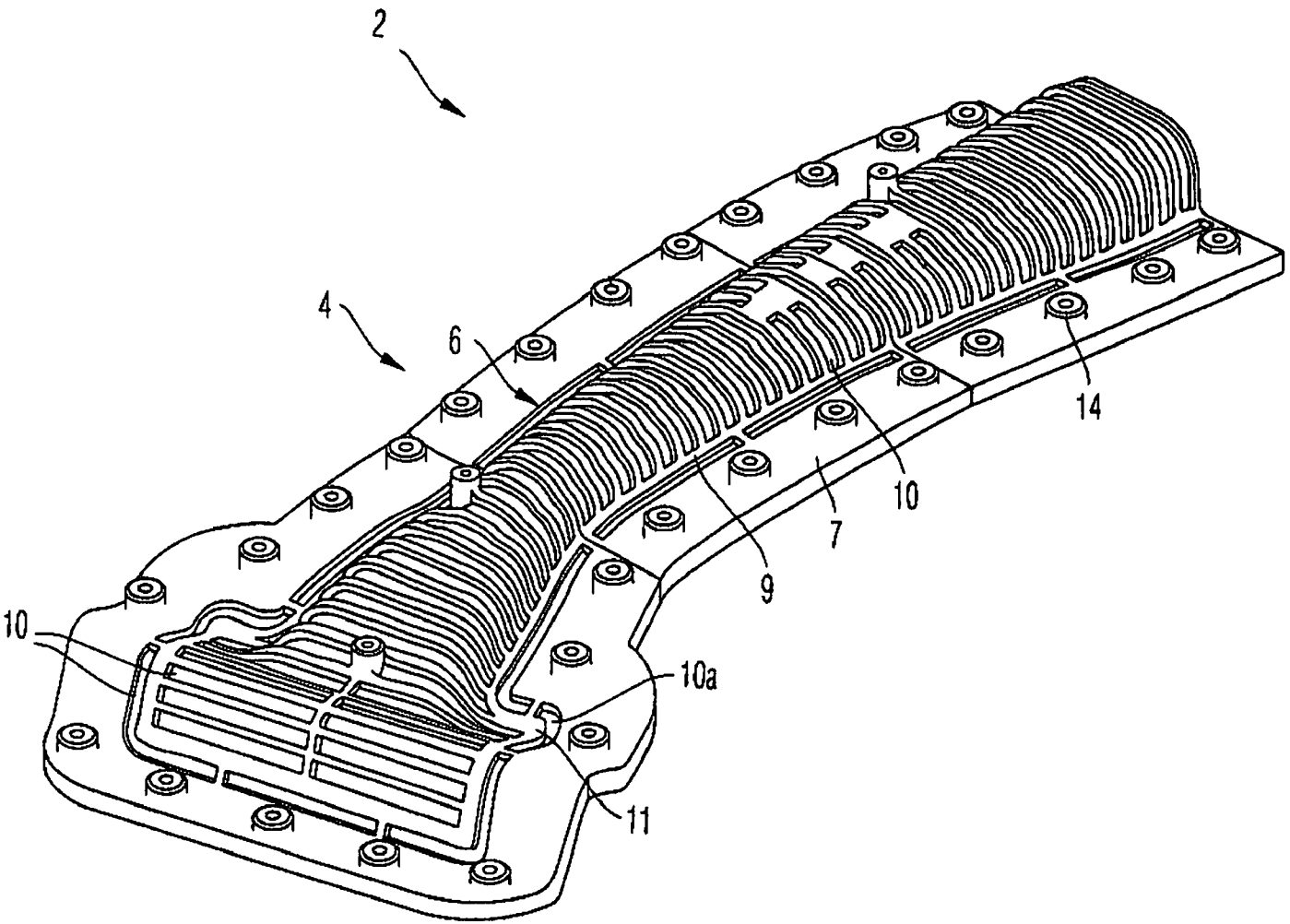
FIG. 2 shows the shaping surface shell of a shaping tool according to the invention and a shaping tool half according to the invention, viewed from the rear side.

Correspondingly, each shaping surface shell 4 has a shaping surface 8, which is oriented toward a work piece to be shaped, and a correspondingly contoured rear side 9 (FIG. 2).

In the region of the rear side 9 and in the contoured region 6, the shaping surface shell 4 has cooling conduits 10 that are milled into the material of the shaping surface shell 4 or are introduced into it in another suitable fashion. The cooling conduits 10 have an essentially rectangular or U-shaped cross section and can extend transversely or longitudinally in the contoured region.

Between the contoured region 6 and the flange region 7, the shaping surface shell 4 can have a clamping region 11. The purpose of the clamping region 11 is to secure the work piece as snugly as possible on all sides in order to assure that when a shrinkage occurs, the work piece rests against certain regions of the respective shaping surfaces 8, without drawing material in from the flange region 7. Correspondingly, the clamping region 11 is preferably free of cooling conduits; cooling conduits 10*a* can, however, be situated adjacent to the clamping region 11 so that the clamping region is delimited by the actual cooling conduits 10 in the contoured region and cooling conduits 10*a* from the flange region 7.

In order to attach the shaping surface shell 4 to the form supporting halves 5, bores 12 for receiving threaded bolts 13 are provided in the flange region 7. Correspondingly, these threaded holes in the vicinity of the shaping surface 8 have sunken regions that are designed so that a bolt head can be accommodated in the sunken region or in a corresponding recess so that it does not protrude up from the shaping surface.

Figure 4:
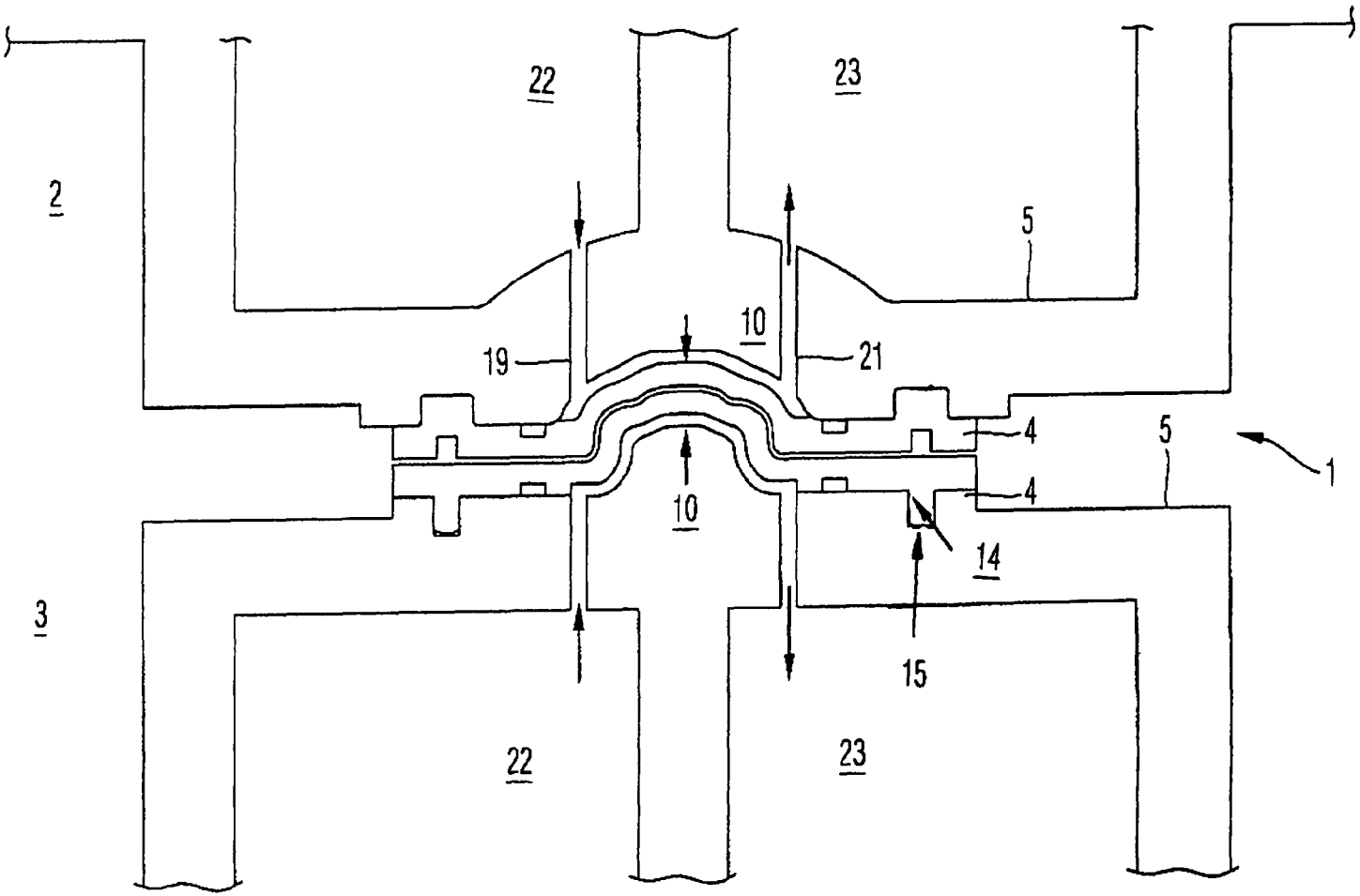
FIG. 4 is another schematic cross section through a shaping tool according to the invention.

On the rear side 9, dome-like or truncated cylinder-like protrusions 14 can be provided, which encompass the threaded holes 12. The protrusions 14 can engage in corresponding recesses 15 in the form supporting halves 5 (FIG. 4) and can thus achieve a centering and support of the shaping surface shell on the form supporting half. However, it is also possible for centering protrusions and corresponding centering recesses to be provided in locations other than at the threaded holes.

Figure 3:
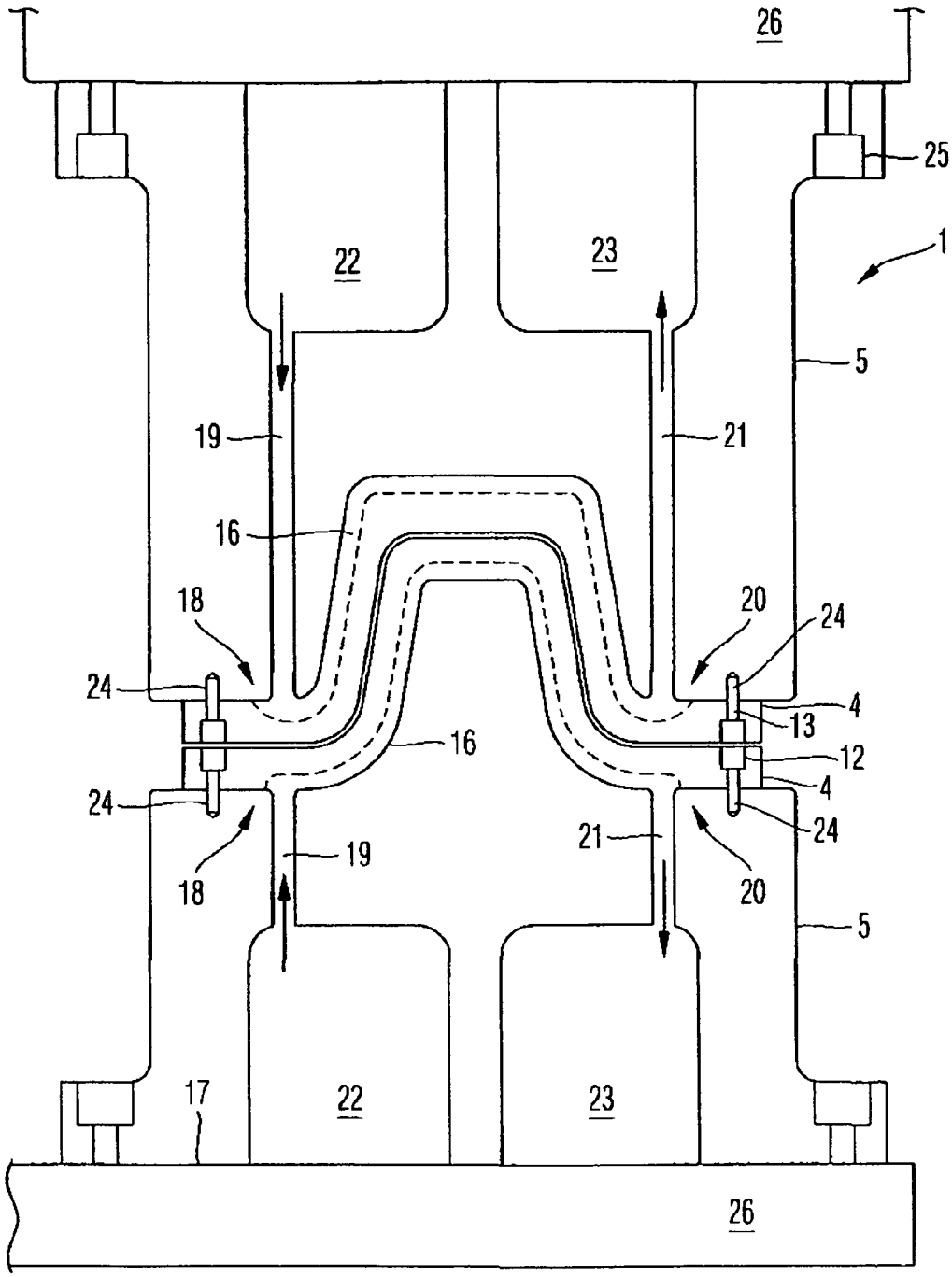
FIG. 3 is a schematic cross section through a shaping tool according to the invention, with a pressed work piece.

The form supporting halves 5 (FIG. 3) are for example embodied as block-shaped and in the closed state of the form (FIG. 3), have receiving surfaces 16 oriented toward each other for receiving shaping surface shells and rear sides 17 opposite from them.

The receiving surfaces 16 have a contour that corresponds to the rear side contour of the shaping surface shells 4. This means that in the assembled state, the shaping surface shells 4 rest against the receiving surfaces 16 in a form-locked fashion. This forms the cooling conduits 10, i.e. the grooves in the rear side of the shaping surface shells 4 cooperate with the receiving surfaces 16 to form cooling conduits. In order to permit a coolant to flow through the cooling conduits 10, in a starting region 18 of each cooling conduit with reference to the longitudinal span of the cooling conduits 10, an inlet conduit 19 is provided, which extends through from the rear side 17 of the form supporting half 5 to the receiving surface 16 and feeds into the cooling conduit 10. In an end region 20 with reference to the longitudinal span of the conduit 10, a respective outlet conduit 21 is provided, which extends from the rear side 17 of the form supporting half 5.

In order to be able to supply water uniformly to all inlet conduits 19 and all outlet conduits 21 and in order to be able to drain away exiting cooling water or coolant, a continuous inlet chamber 22 or outlet chamber 23, which are situated adjacent to each other and extend parallel to each other, are introduced, in particular milled or recessed, into the form supporting half 5 from its rear side 17. The inlet conduits 19 and outlet conduits 21 extend from the bottom of these chambers 22, 23 to the receiving surface 16. In this connection, a respective inlet conduit 19 and outlet conduit 21 can be provided for each conduit 10. The inlet conduits 19 and outlet conduits 21 can, however, also be embodied as largely slot-shaped and can each act on a multitude of conduits with coolant.

In the region of the threaded holes 12 and the threaded bolts 13, each form supporting half 5 has corresponding threaded bores 24 for accommodating the bolts 13.

In the vicinity of the rear side 17, each form supporting half 5 also has the corresponding threaded holes 25 in order to screw each form supporting half 5 snugly to a form baseplate 26; the form baseplates 26 support the forms and are connected to corresponding moving elements so that the form supporting halves 5 with the shaping surface shells 4 mounted on them can be moved toward and away from one another.

Figure 5:
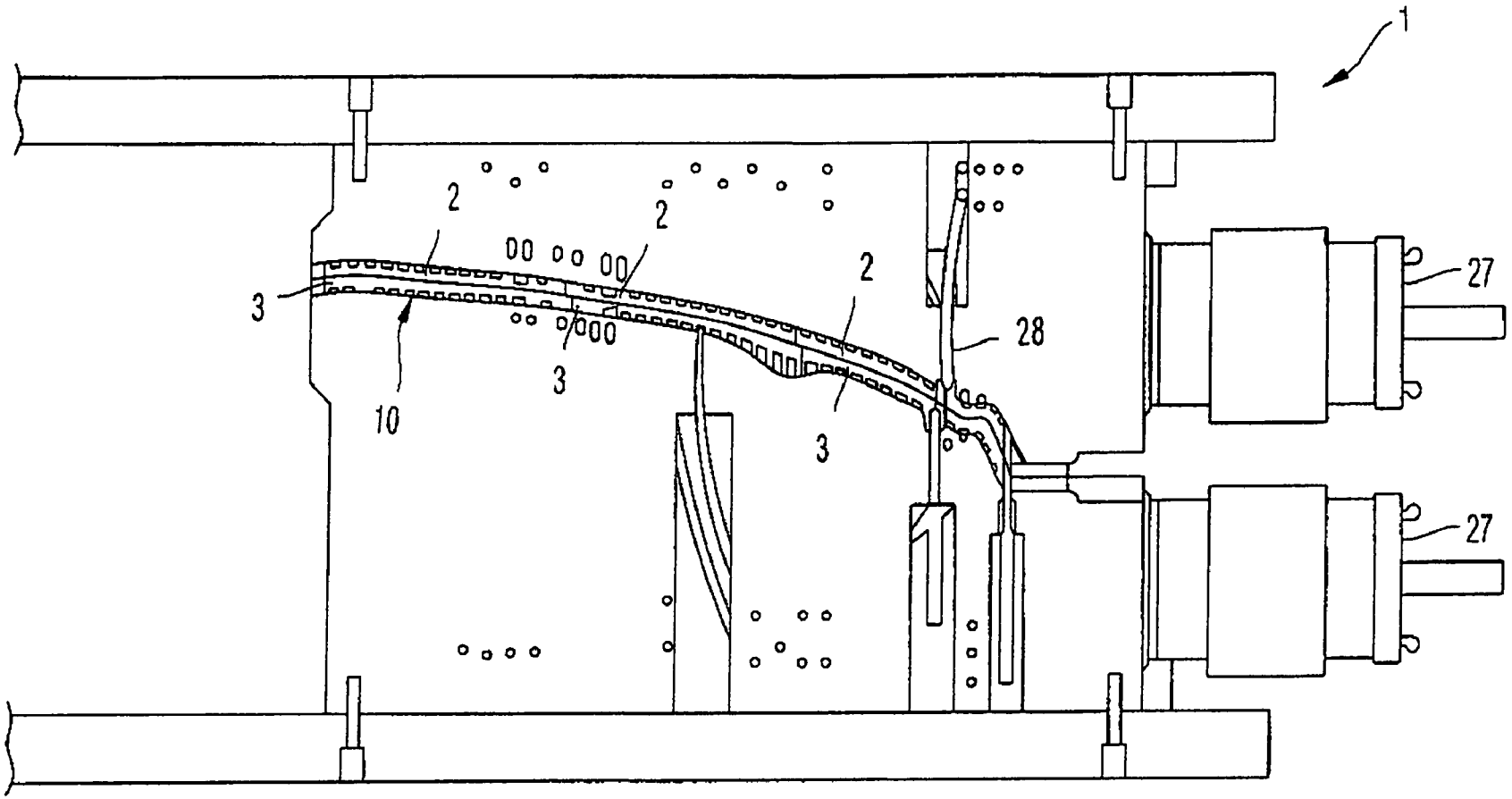
FIG. 5 is a schematic longitudinal section through the shaping tool according to the invention.

In the region of side walls of the form supporting halves 5, the chambers 22, 23—from which the inlet conduits 19 and outlet conduits 21 lead—are routed out of the respective form supporting halves 5 with corresponding connection elements 27 in order to correspondingly connect the form supporting halves to the water supply or coolant supply and to the coolant outlet (FIG. 5).

In order to detect the temperatures of the work piece and of the shaping surface shells 4, temperature sensors 28 can be provided (FIG. 5). In addition, circumferential seals can be provided in the vicinity of all screw connections in order to achieve the tightness of the system.

The shaping surface shells 4 are made of a tool steel or a cast material. Preferably, these shaping surface shells are composed of a copper alloy, a bronze, or a pure copper. The form supporting halves 5 are composed of a cast material such as gray-cast iron or cast steel. But since the form supporting halves are not subjected to any particularly high thermal load, with a corresponding dimensioning, it is also possible to embody the form supporting halves 5 of a plastic material such as polyamide, polyethylene, or polypropylene. Fiber-reinforced plastic compound materials can also be used. This permits a particularly light-weight, but also stable embodiment.

With the present invention, it is advantageous that a form with a significantly improved heat dissipation can be manufactured in a simple, inexpensive fashion. This yields shaped parts with uniform properties and results in significantly shorter cycle times since the cooling takes place more quickly. In addition, both the form and the component itself are subjected to fewer thermal stresses caused by different cooling capacities in the cross section of the form.

As it is clear from the drawings, the length of the cooling conduits is relatively short and in particular, is limited to the contoured region 6. Conventional cooling conduits that travel through the entire form are considerably longer. As a result, the invention achieves a short cooling length or conduit length, additionally achieving a low loss of pressure. The size and dimensions of the cooling conduits are precisely calculated to the amount of energy required for an effective dissipation of the heat. Because a short cooling length of the conduits is achieved, the temperature distribution in the cooled region is also very homogeneous, thus avoiding component distortion and also form distortion.

In trials, the cooling system according to the invention has turned out to be so efficient that the cooling water does not have to be cooled down a great deal as it does in conventional forms, but can instead easily be used at temperatures of 20 to 50° C. Even with such warm water, after the initial introduction of a warm forming piece, a stable processing temperature, i.e. a temperature that develops on a long-term basis in the form during the shaping of work pieces, is already achieved after the first five shaping procedures. This means that a stable, desired process is achieved very quickly so that here, too, a very favorable homogeneity is achieved from component to component. In addition, the use of a relatively warm cooling water reduces the cooling expense and therefore the energy expense to a very large extent. Relatively simple cooling systems can be used to cool down the cooling water or coolant, for example flow-exposed water coolers (radiators) or small cooling tower units.

The heat capacity is relatively low because the forming surface shell is relatively thin by contrast with conventional shaping tools and also because it has a multitude of cooling grooves milled into it from the rear and the partitions remaining between the cooling grooves constitute cooling ribs. As a result, an operating temperature is reached very quickly, which temperature is determined solely by the quantity and temperature of the water flowing through. It is thus possible to quickly reach the desired stable operating and processing temperature and consequently to assure a uniform production right from the start. This effect is further amplified if a material (bronze, copper, Ampcoloy®) is used, which has a lower heat capacity and a higher thermal conductivity than the conventional materials (steel, cast steel).

The partitions or cooling ribs between the grooves do in fact rest against the receiving wall of the form supporting half 5; however, since the material does not extend homogeneously here, but instead, the partitions protrude up from the receiving wall, this interrupts the thermal conduction so that the heat from the shaping surface shell is only very poorly transmitted to the form supporting half. This means that the form supporting half is under little thermal load and can therefore also be composed of less temperature-resistant materials. This effect can be further amplified if a seal is provided between the shaping surface shell and the form supporting half.

Tool Description: Shaping shells on the upper and lower part composed of an Ampco alloy or, depending on the application, also of tool steel, are screwed to a support casting composed of gray-cast iron or cast steel into which the water chambers are already cast. The material thickness of the shells is between 10 mm and 40 mm, depending on the application and the sheet thickness of the steel component to be hardened.

Cooling conduits spaced equidistantly apart from one another are milled into the shaping shells from the rear; the cooling conduits in the shells are connected to the water chambers by means of bores in the base support.

Water Circuit: The cooling chambers in the support tool are connected to water hoses, which are connected to the inlet and outlet chambers; then, the water is conveyed by means of pressure into the inlet chambers, via the inlet bores, into the milled cooling conduits, through the outlet bores into the outlet chamber, and back to the cooling tank; the heat dissipation of the steel part to be hardened can occur in very rapid intervals and very uniformly, thus assuring the optimum press hardening of the steel part.

Advantages over the known form/press hardness/and tool variants:

- Cooling conduits are milled into the shaping/cooling shells from the rear; by contrast with cooling bores in the known shaping and hardening tools, the cooling conduits can be introduced at a parallel distance from the surface geometry (EVEN WITH NEGATIVE RADII); this permits the occurrence of a uniform temperature conductance and consequently also a uniform hardening of the steel part.
- The milled cooling conduits in the cooling shells make it possible for the coolant to flow through as close as necessary to the partial surface geometry to be cooled (depending on the sheet thickness of the steel part to be hardened). Due to the proximity of the cooling conduits to the surface of the part geometry, the heat there can be imparted to the cooling water very quickly, as a result of which, by contrast with the known shaping and press-hardening tools, a reduced holding time in the press hardening process can be achieved, thus resulting in a shorter cycle time and therefore also permitting a more reasonably priced production of the steel parts to be hardened!

Depending on the requirements and material thickness, the cooling/shaping shells can be manufactured out of an Ampco alloy: very good thermal conductivity, optimal cycle time or of tool steels—long service life, good heat dissipation via cooling conduits The shell thickness, depending on the sheet thickness and on the requirements of the steel part to be cooled, can be determined individually Since the shells can be manufactured out of a number of shell segments, it is possible, in the event of tool wear or repairs, to very quickly produce replacement shells With the conveyance of water through the milled cooling conduits, due to the optimum flow properties and water turbulence, it is possible to operate with very low water pressure, thus also making it possible to cut costs.

The invention claimed is:

1. A shaping tool for shaping sheet steel components, the shaping tool comprising:

at least two shaping tool halves;

contoured regions are provided in a vicinity of the shaping tool halves in order to give a corresponding contour to at least one region of a work piece;

each shaping tool half has a shaping surface shell, which is oriented toward the work piece, and a form supporting half;

the shaping surface shell is arranged on the form supporting half and the shaping surface shell has a shaping surface oriented toward the work piece and a rear side oriented away from the work piece;

the form supporting half has a contoured region, which essentially corresponds to the contour of a work piece, and the contoured region is surrounded by a flange region;

grooves are provided in the contoured region in a vicinity of the rear side of the shaping surface shell;

the form supporting halves have receiving surfaces with a contour that corresponds to a rear side contour of the shaping surface shells, with the receiving surfaces and grooves forming cooling conduits; and the form supporting halves have inlet conduits and outlet conduits connected to an inlet chamber and an outlet chamber, respectively, so that a coolant can be conveyed uniformly through the conduits.

* * * * *